US005348548A

United States Patent [19]

Meyer et al.

[11] Patent Number: 5,348,548

[45] Date of Patent: Sep. 20, 1994

[54] TWO-COMPARTMENT STORAGE AND TRANSFER FLASK

[75] Inventors: Gabriel Meyer, Vesenaz; Joseph Meyer, Borex, both of Switzerland

[73] Assignee: Becton Dickinson France S.A., Le Pont de Claix, France

[21] Appl. No.: 752,640

[22] PCT Filed: Dec. 30, 1990

[86] PCT No.: PCT/EP90/02332

§ 371 Date: Aug. 28, 1991

§ 102(e) Date: Aug. 28, 1991

[87] PCT Pub. No.: WO91/10417

PCT Pub. Date: Jul. 25, 1991

[30] Foreign Application Priority Data

Jan. 8, 1990 [CH] Switzerland ..... 45/90-7

[51] Int. Cl.[5] ..... A61J 1/00

[52] U.S. Cl. ..... 604/403; 604/415; 604/416

[58] Field of Search ..... 604/410, 416, 403, 407, 604/408, 409, 404, 412, 414, 415; 206/219-222; 215/287

[56] References Cited

U.S. PATENT DOCUMENTS

| | | | |
|---|---|---|---|
| 2,764,983 | 10/1956 | Barasch . | |
| 3,734,098 | 5/1973 | Schneller et al. . | |
| 4,031,892 | 6/1977 | Hurschman | 604/416 |
| 4,234,083 | 11/1980 | Cohen | 206/221 |
| 4,550,825 | 11/1985 | Sutryn et al. | 206/221 |
| 4,589,879 | 5/1986 | Pearson | 604/411 |
| 4,871,354 | 10/1989 | Conn et al. | 604/89 |
| 4,927,013 | 5/1990 | Van Brunt et al. | 206/221 |
| 4,950,237 | 8/1990 | Henault et al. | 604/82 |
| 5,056,676 | 10/1991 | Allen et al. | 215/287 |

FOREIGN PATENT DOCUMENTS

| | | |
|---|---|---|
| 0099754 | 2/1984 | European Pat. Off. . |
| 0324257 | 7/1989 | European Pat. Off. . |
| 8705240.7 | 9/1987 | Fed. Rep. of Germany . |
| 2239390 | 2/1975 | France . |
| 2319544 | 2/1977 | France . |

*Primary Examiner*—Robert A. Hafer
*Assistant Examiner*—Sam Rimell

[57] ABSTRACT

Bottle (10) for storage and transfer with dual compartments (11 and 12) separated during storage by a movable intermediate seal (13). The bottle (10) also has a narrow neck (15) in which a sealing device engages comprising an elastomeric sealing member (61) and a capsule (17) attached to said member. The capsule extends toward the outside into a tip (18) in which there is a closing valve (63) urged by a spring (62) which supports a disc (60*b*) of a rigid element (60) attached to the inside of the sealing member (61).

8 Claims, 14 Drawing Sheets

TWO-COMPARTMENT STORAGE AND TRANSFER FLASK

The present invention concerns a dual compartment storage and transfer bottle designed to store two components of a medicinal substance, at least one of which is in the liquid state, and to transfer this substance directly or after mixing it with another substance into a utility device, said bottle comprising at one end a narrow open neck and a sealing device engaged in said neck, and at the other end, a narrow region sealed during the storage phase by a movable intermediate seal designed to separate the two compartments and to isolate the two components from each other, said sealing device comprising an elastomeric sealing member engaged in the narrow neck and designed to be displaceable between a first position, known as the storage position, during a storage phase in which it constitutes a tight seal, and a second position, known as the utility position, during a utility phase in which it allows said medicinal substance to be evacuated, and a rigid capsule partially engaged inside the narrow neck and attached to said sealing member.

Various bottles of this type are known in which changing from the storage position to the utility position necessitates ejecting the movable intermediate seal toward the lower compartment to mix the components which are respectively stored in the upper compartment and in the lower compartment during the storage phase. In this type of bottle, the upper compartment is completely filled with a substance in liquid state and the pressure exerted on the sealing member to make it pass from its sealing position to its storage position is integrally transmitted to the movable intermediate seal by this liquid substance. For certain applications this construction is too complicated and too costly and unsuitable, given the fact that the upper compartment may be completely or partially filled, or filled with a powder. For this reason, rigid devices are provided in certain embodiments to activate the bottle, that is, to push back the movable intermediate seal. The presence of these rigid devices generally constitutes a disadvantage because they are in contact with the component held in the upper compartment and cause considerable problems of compatibility between the medicinal substance and the synthetic material from which the rigid devices are made.

The present invention proposes to resolve this problem by realizing a bottle which can be made simply and economically and can be used for storage and application of any type of medicinal substance without posing any problem of compatibility between the substances stored in the bottle and the bottle components.

To achieve this, the bottle according to the invention is characterized in that the elastomeric sealing member has one sealing section with an outside diameter essentially equal to the inside diameter of the narrow neck to ensure that the bottle seals at the neck level during the storage phase, and an extension prolonging the sealing section through the upper compartment defined by the sealing section and the movable intermediate seal to ensure mechanical connection between the capsule and said seal.

According to a preferred embodiment, this bottle may comprise a rigid element attached inside the extension of the sealing member, said rigid element being integral with the capsule.

Preferably this rigid element consists of a central shaft forming one piece with the capsule, or may be a separate piece positioned between the capsule and the extension of the sealing member.

According to this embodiment of the bottle the sealing section of the sealing member comprises at least one radial opening sealed by the interior wall of the narrow neck during the storage phase and open toward the inside of the upper compartment during the utility phase.

Advantageously, when the capsule comprises a tube shaped end tip, this tip has a sealing valve urged by a spring.

This spring preferably contacts the rigid element, said rigid element being associated with a disc in contact with the capsule base and serving as a support for said spring.

Said disc may comprise at least one opening to allow communication between the upper compartment and the capsule tip.

In a preferred embodiment, the capsule comprises a base and this base comprises at least one opening serving as a vent hole, which may comprise a filter.

Said filter may be attached to the outside or the inside of the capsule base.

According to another embodiment, the sealing member comprises one narrower region designed to be punctured by the needle on a syringe.

The present invention will be better understood with reference to the description of several exemplary embodiments and to the attached drawing, in which.

Figure 1:
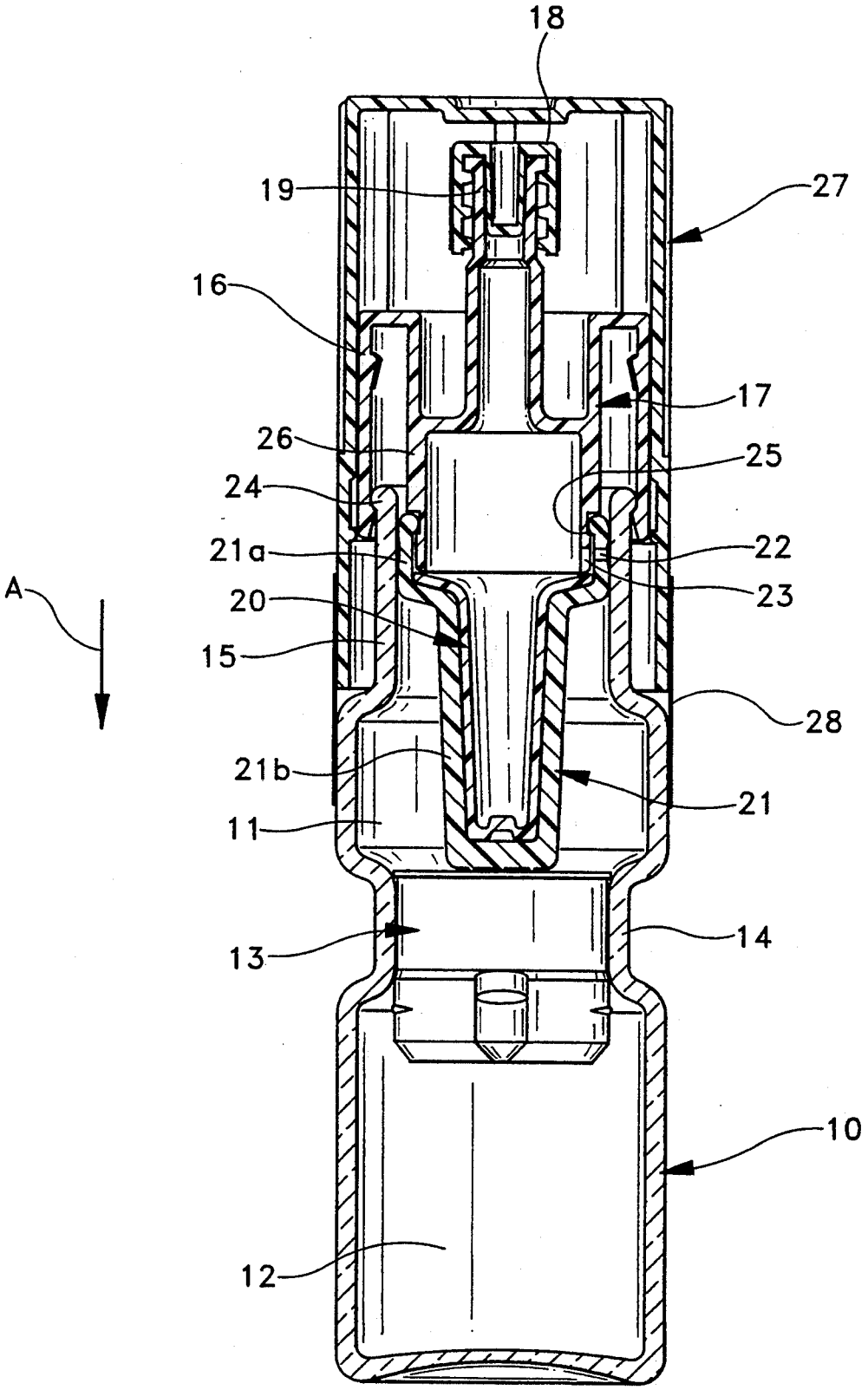
FIG. 1 illustrates a first embodiment of the bottle according to the invention in storage position.
Figure 2:
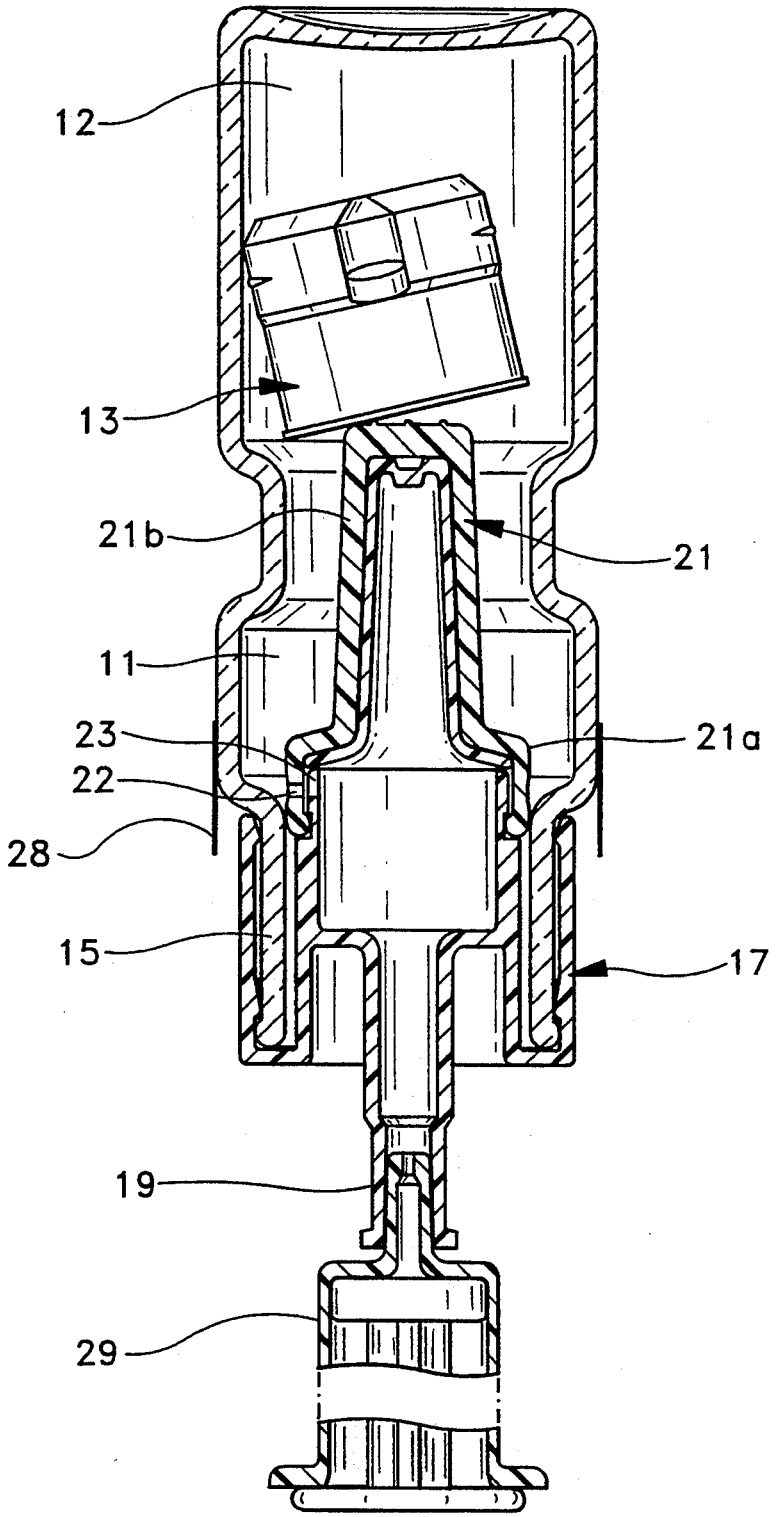
FIG. 2 shows the construction of FIG. 1 in utility position and attached to a syringe.

With reference to FIGS. 1 and 2, storage bottle 10, which may be made of synthetic material such as, for example, polyethylene, or glass or any other suitable material, comprises two compartments, 11 and 12, respectively, separated by a movable intermediate seal 13 engaged in narrow central region 14, the diameter of which is calculated to allow the seal to seal it completely.

At the upper extremity with narrow neck 15, which is essentially equal in section to central zone 14, bottle 10 has a sealing device 16 comprising on one side a capsule 17 made of synthetic material closed by a seal 18 screwed onto threaded tip 19 formed at the outside end of capsule 17 and on the other side, an elastomeric sealing member 21. In the construction described and illustrated in these drawings, capsule 17 is extended by a rigid element 20 which rigidifies said sealing member. Note that sealing member 21 consists of a sealing section 21*a* essentially equal in diameter to the inside diameter of the narrow neck to ensure sealing of the bottle at neck level during the storage phase, and of an extension 21*b* which prolongs sealing section 21*a* through the upper compartment defined by said sealing section and the movable intermediate seal to form a mechanical connection between the capsule and the seal. The unit formed by the sealing member/rigid element is supported by intermediate seal 13 and to a certain extent, constitutes a mechanical connection between the sealing device and the movable intermediate seal. Because of this connection, displacing capsule 17 in the direction indicated by arrow A, which is due to the engagement of this capsule toward the inside of neck 15, allows the movable intermediate sealing plug to be inserted into compartment 12 and consequently frees the passageway between the two compartments at the level of narrow central zone 14.

Note that sealing member 21 has at least one lateral opening 22 which coincides with at least one lateral opening 23 in capsule 17. The purpose of these openings is to allow communication between the two compartments when the bottle is in the utility position shown in FIG. 2.

In this embodiment, rigid element 20 is independent of capsule 17. Conversely, sealing member 21 is integral with this capsule. To achieve this, the sealing member 21 has a peripheral ring 24 engaging in a groove 25 disposed on the periphery of a cylindrical interior extension 26 of the capsule. It will also be noted that in this embodiment, rigid element 20 is held between the sealing member and the extremity of said extension 26 and kept in place by the elasticity of the sealing member.

In the storage position capsule 17 and particularly tip 19 are hidden by a protective cap 27 which is attached to bottle 10 by a tamper-proof seal 28.

FIG. 2 shows the bottle of FIG. 1 in the utility position. Tamper-proof seal 28 has been slit and capsule 17 pushed toward the inside of neck 15. Sealing member 21 which sealed the neck level has been partly pushed inside first compartment 11 and lateral openings 22 and 23 allow the substance held in the bottle to flow toward tip 19 with a female Luer cone in which syringe 29 with a male Luer cone engages. Plunging the capsule toward the inside of the neck has exerted pressure on movable intermediate seal 13, which has fallen inside second compartment 12 (before the bottle is turned over). This force has been transmitted from the capsule to the seal by rigid element 20 and sealing member 21 which covers this element.

This embodiment is particularly interesting because during storage, the medicinal substances are in contact only with the bottle and the elastomeric components such as intermediate seal 13 and sealing member 21. As a result, problems of compatibility between medicinal substances and synthetic material are completely resolved.

Figure 3:
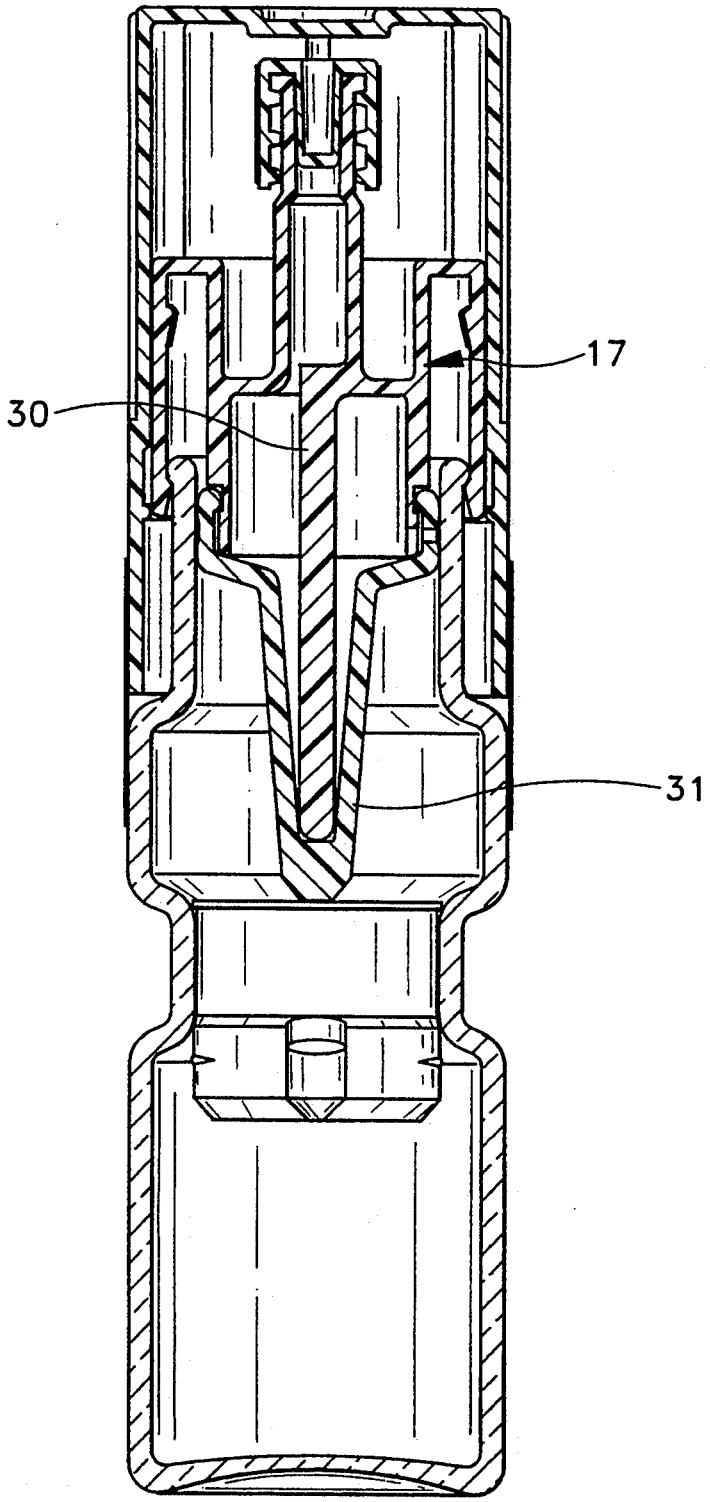
FIG. 3 shows another embodiment of the bottle according to the invention.

FIG. 3 shows another embodiment which is actually a variation of the preceding embodiment shown in FIGS. 1 and 2. Rigid element 20 of the preceding embodiment is replaced in this case by a rigid element 30 integral with capsule 17. The function of this piece is strictly identical to that of element 20. It takes the form of an axially disposed rounded shaft. The shape of device 31, for which rigid element 30 serves as a support, differs slightly at the lower portion. The upper portion, whose function is to seal the neck, has a shape identical to that shown in FIGS. 1 and 2.

Figure 4:
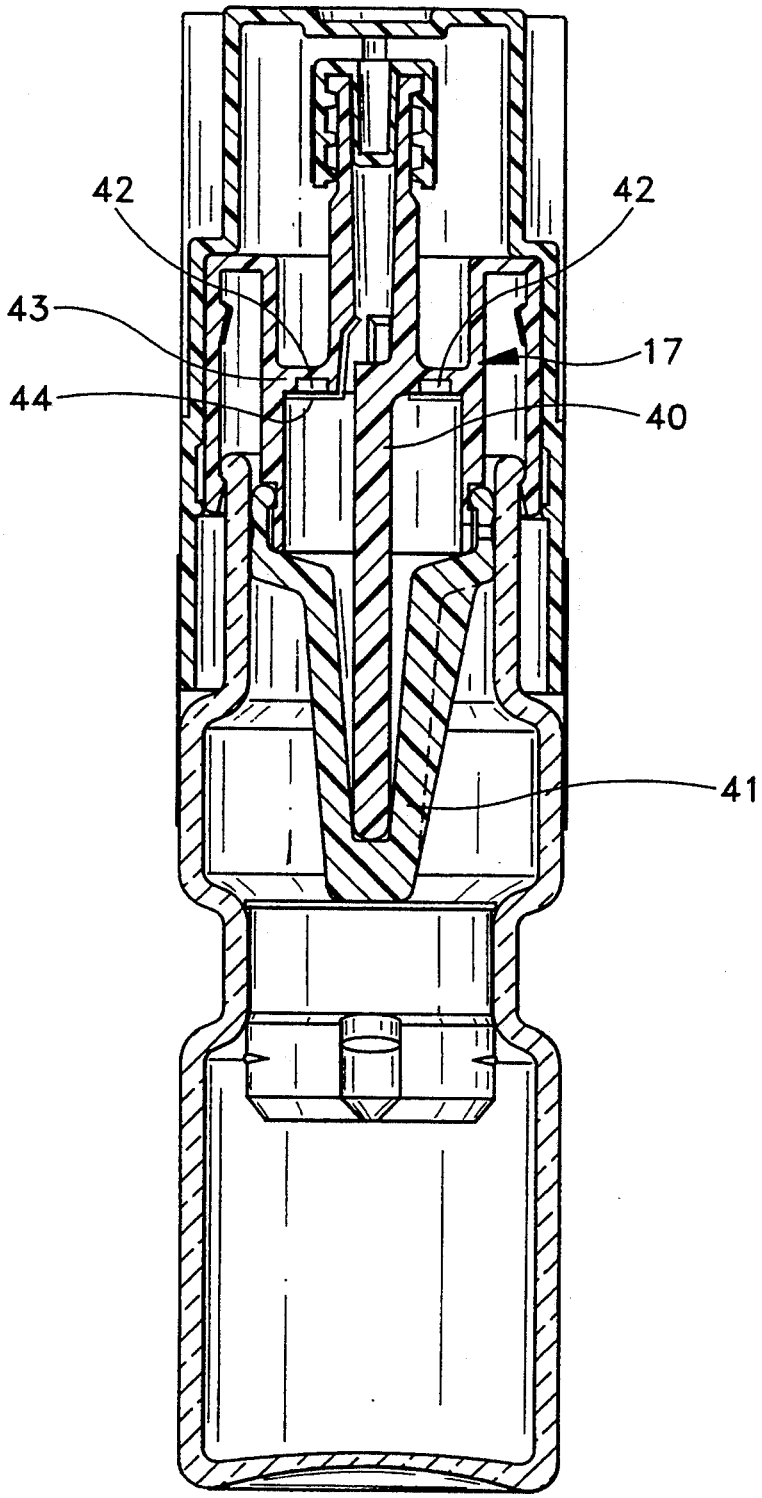
FIGS. 4 and 5 illustrate two other embodiments of the bottle according to the invention, provided with a filter/vent-hole.
Figure 5:
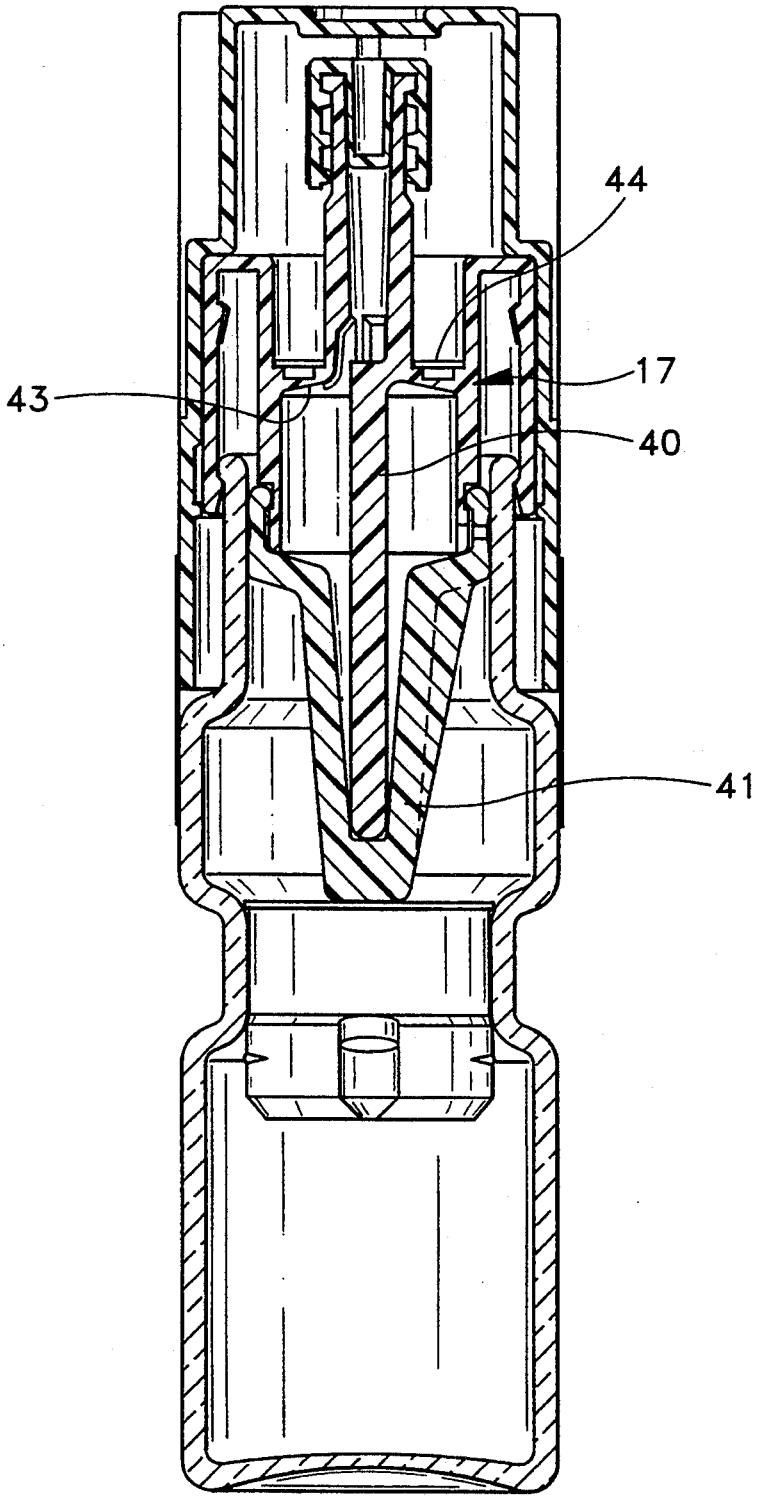

FIGS. 4 and 5 illustrate two different variations of the embodiment shown in FIG. 3. These constructions differ from the preceding one in one respect, by the shape of sealing member 41 supported by rigid element 40 which is essentially identical to rigid element 30 and, in another respect, by the provision of a vent hole disposed in the wall of capsule 17. In the example of FIG. 4, capsule 17 has openings 42 disposed in its base 43. An annular shaped filter 44 is attached to this base to cover these openings. This filter may have two functions, a first function consisting of permitting evacuation of gases such as anhydrous carbon, which may be released in fairly large quantities during mixture of the two components initially stored in the two compartments, or such as air which is in suspension when the sealing member is inserted into the neck, and a second function which consists of allowing filtered air to re-enter when the mixture of components is aspirated with a syringe.

In the embodiment of FIG. 5, filter 44 is located outside base 43 of the capsule. The filter has the same functions in both examples.

Figure 6:
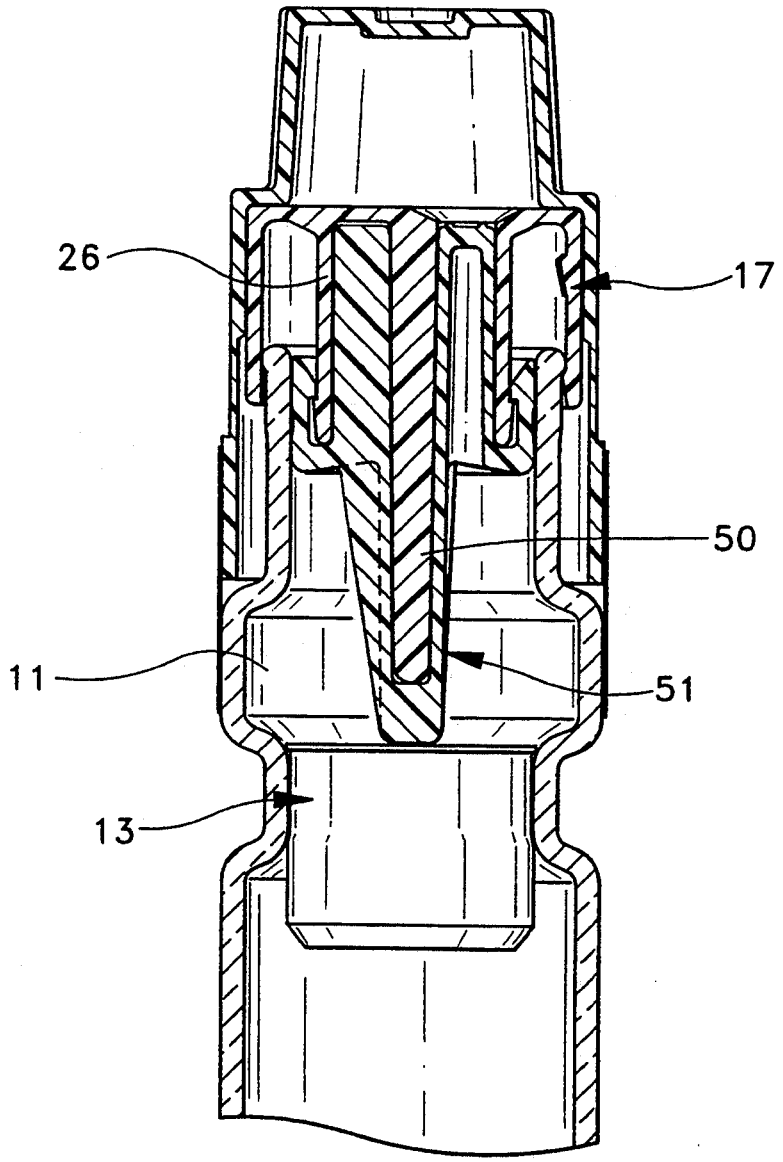
FIGS. 6 and 7 are partial views of a variation of the bottle according to the invention in storage position and activated position, respectively.
Figure 7:
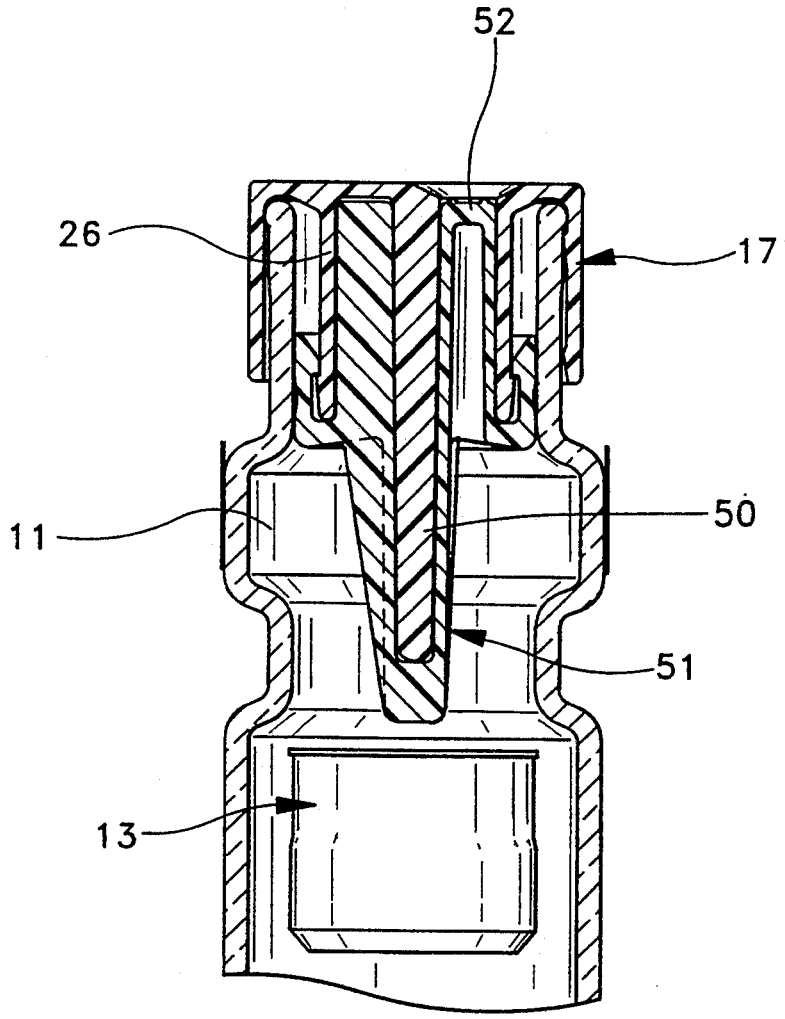

FIGS. 6 and 7 show another embodiment which, nevertheless, duplicates the principal characteristics of the preceding examples. Capsule 17 forms one piece with rigid element 50 which is in the form of a central shaft attached to the base of the capsule and extending axially through first compartment 11. Sealing member 51 surrounds this rigid element and bends back around the cylindrical interior extension 26 of the capsule, to which it is attached by a peripheral ring so as to ensure sealing of the neck.

After activating the system, that is when the movable intermediate seal has been pushed back, the medicinal mixture is removed by means of a syringe (not shown). Region 52 of the sealing member, which is thinner, is punctured with the syringe needle.

Figure 8:
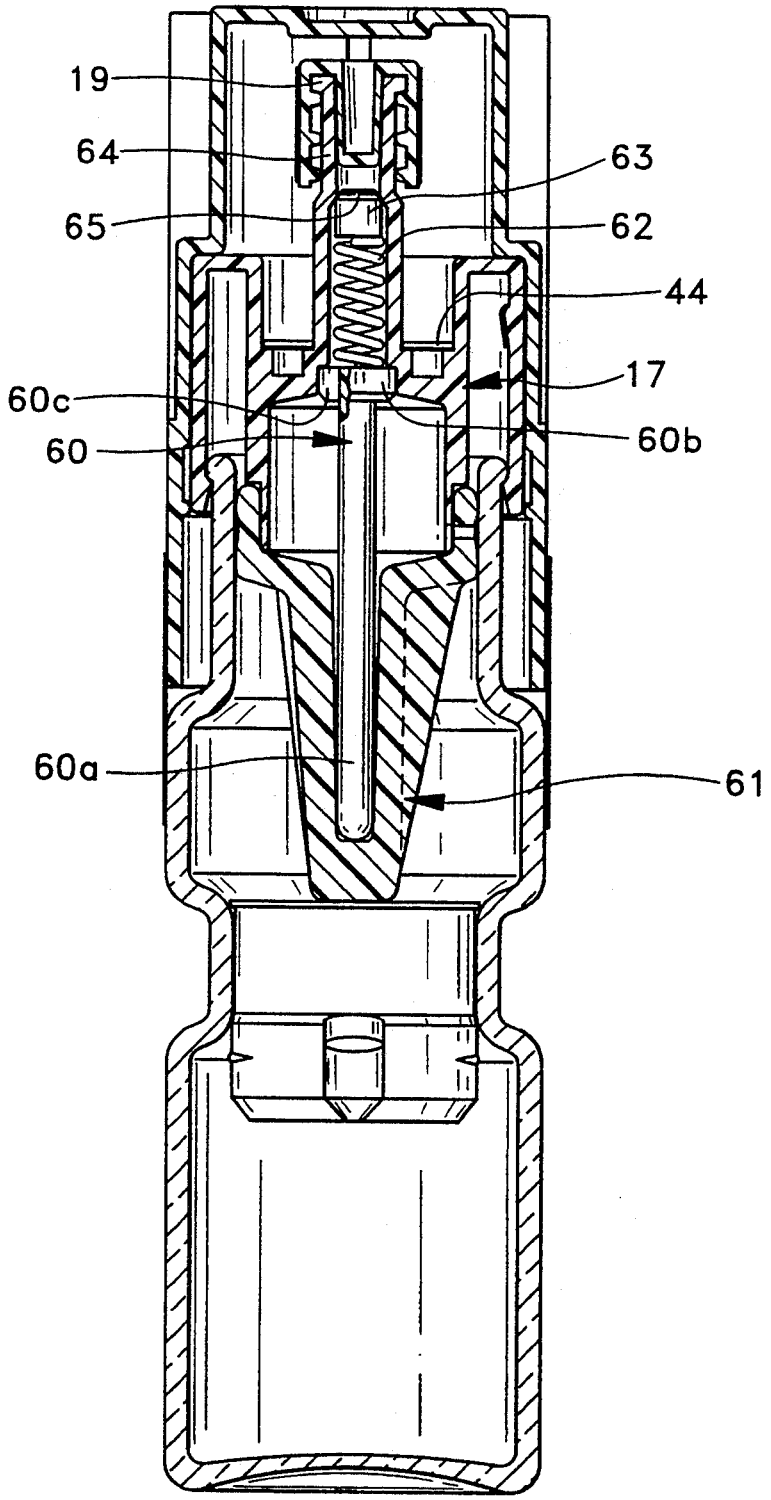
FIGS. 8 and 9 show the preferred embodiment of the bottle according to the invention in storage and in use, respectively.
Figure 9:
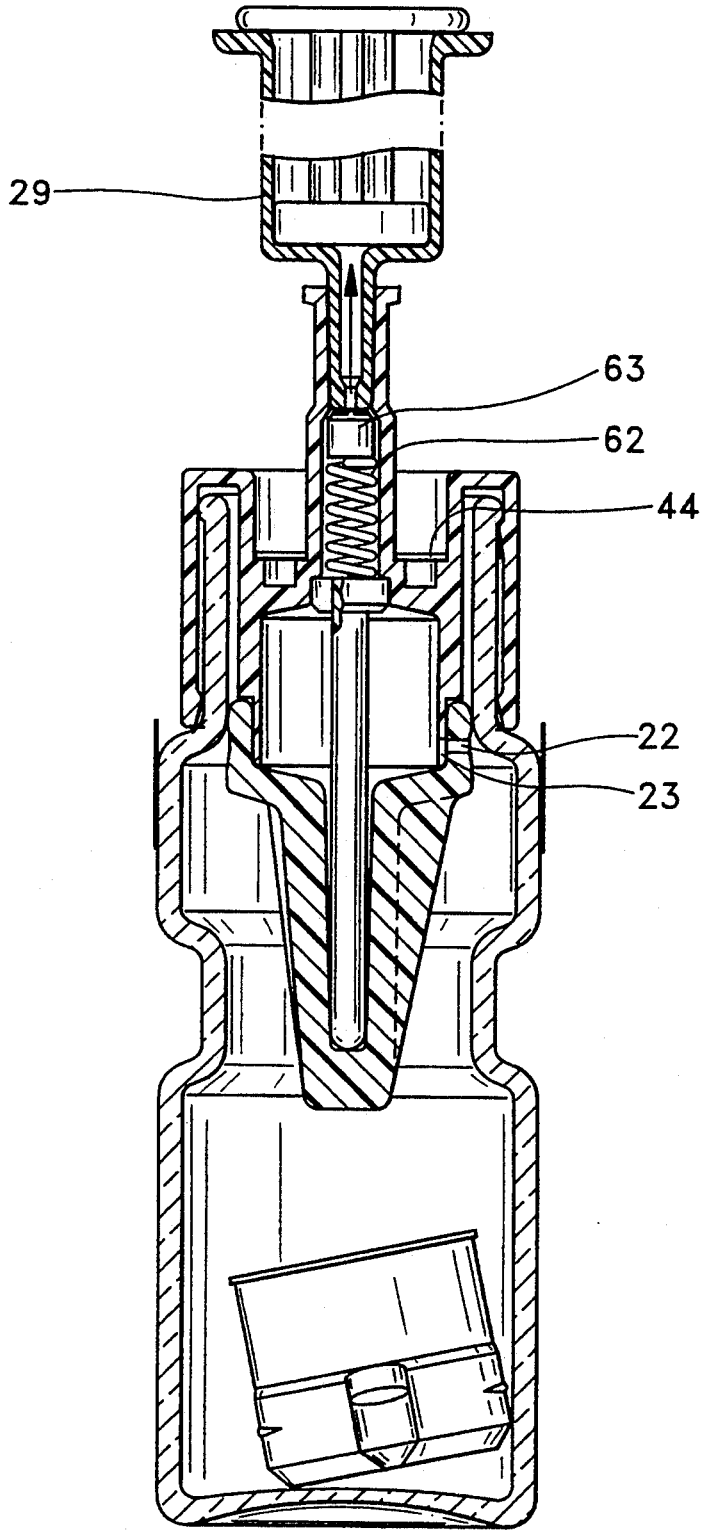

FIGS. 8 and 9 show an especially interesting embodiment in which the bottle remains sealed even after activation because of the provision of a valve. Capsule 17 is essentially identical to that shown in FIG. 4, and sealing member 61 is identical to sealing member 41 of FIG. 4. Rigid element 60 comprises a central shaft 60*a* terminating in a disc 60*b* housed in a circular opening located in the capsule base. This disc comprises an opening 60*c* to allow communication between the inside of the bottle and tip 19 of the capsule. Disk 60*b* serves as a support for spring 62 which has a valve 63 for closing the tip. For this purpose, tip 19 has a narrowed portion 64 and valve 63 has a truncated portion 65 which cooperate to ensure sealing of this closure. Shaft 60*a*, disc 60*b*, spring 62 and valve 63 are made of one piece by injection of a synthetic material compatible with the medicinal substance in the bottle.

After activation of the bottle, the seal is maintained at tip level. When a syringe 29 is connected to this tip, the needle-holding cone of this syringe pushes back valve 63 and compresses spring 62. The medicinal solution in the bottle can pass through openings 22, 23, 60*c* (after the bottle has been turned over) and penetrate syringe 29.

Another advantage of this system is its potential for multidose use. Actually, when syringe 29 is retracted, the valve closes and tightly seals the tip of the capsule.

Capsule 17 is equipped with a vent hole and filter 44, identical to that of FIGS. 4 and 5.

Figure 10:
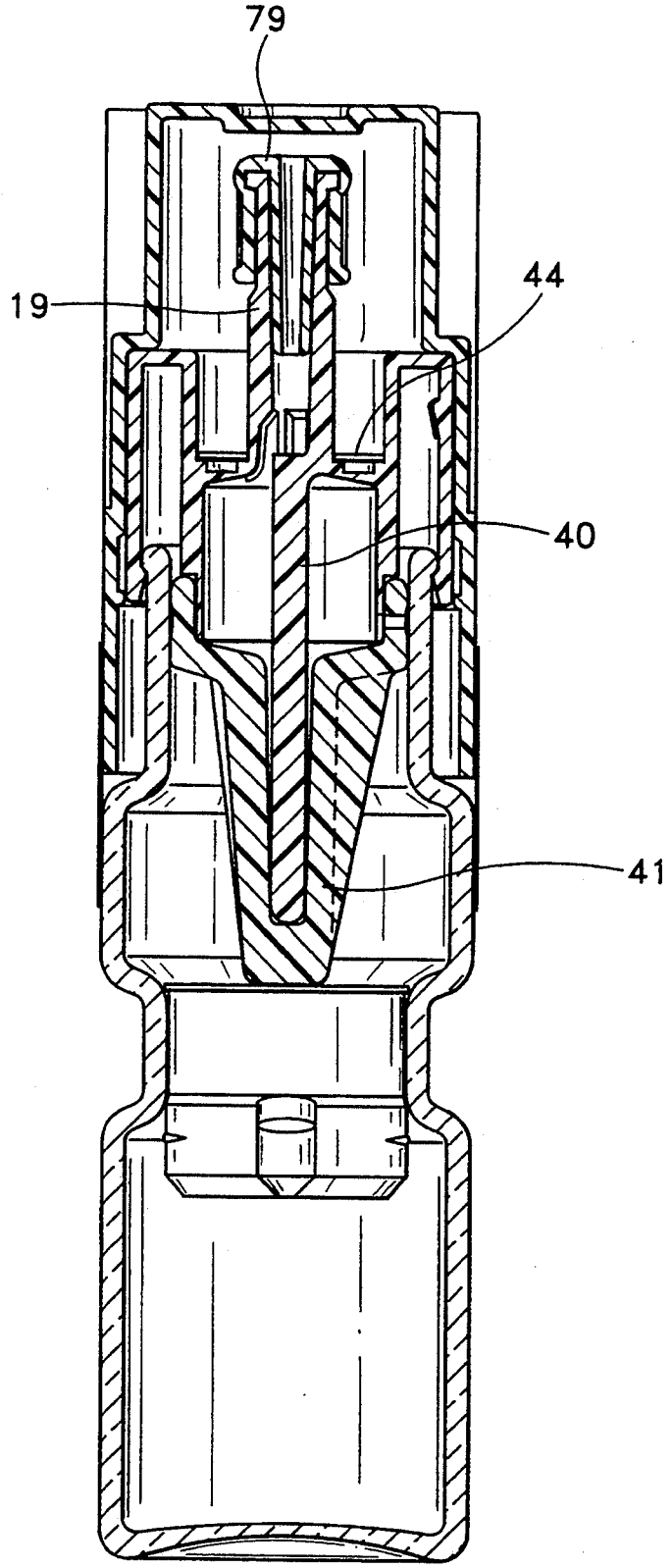
FIGS. 10 through 14 show several variations of bottle embodiments according to the invention.
Figure 11:
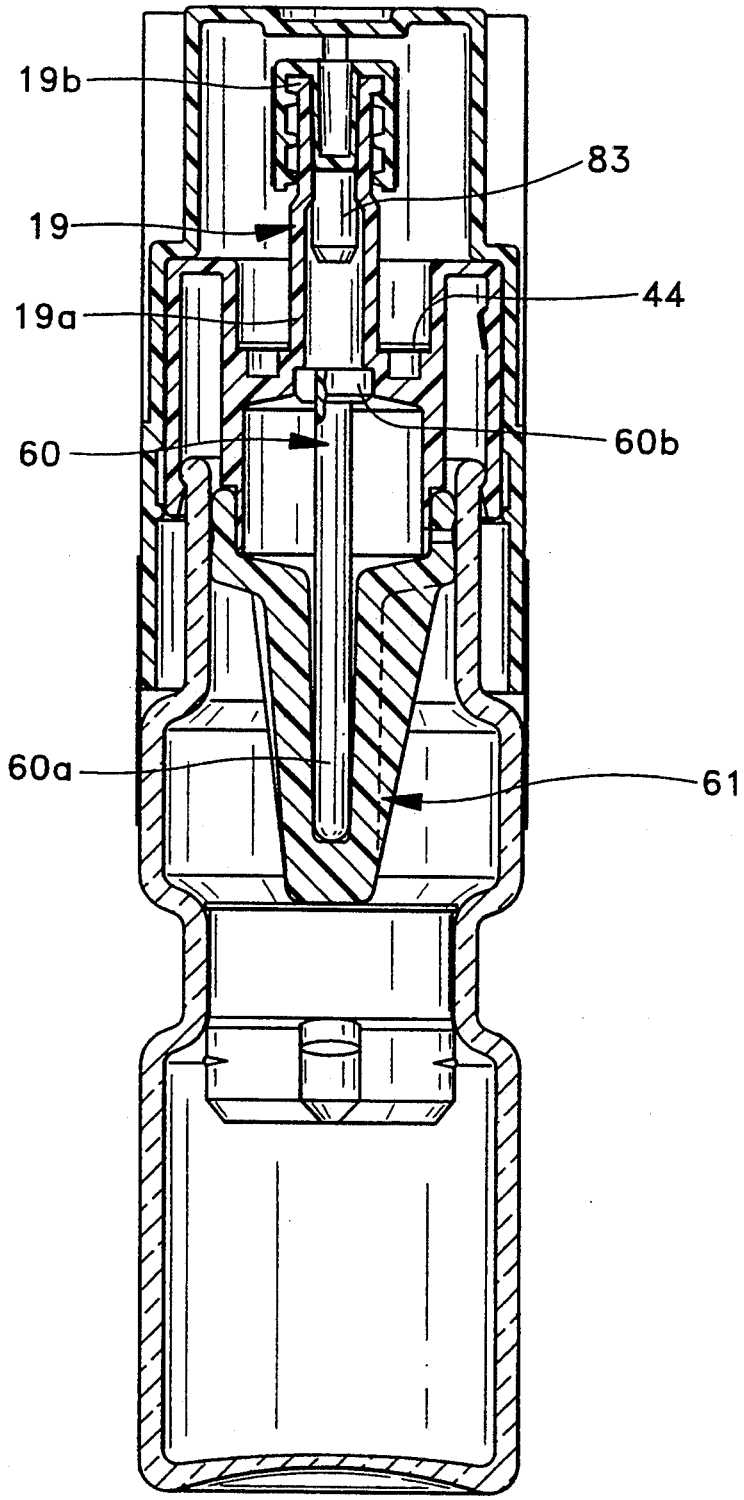

FIGS. 10 and 11 approximately parallel the construction of FIGS. 4 and 8. However, in the example of FIG. 10, tip 19 is sealed by an elastomeric seal 79 called a septurn. The liquid is removed from inside the bottle with a syringe, the needle of which must have previously punctured the septum. In the example of FIG. 11, tip 19 consists of a wide region 19*a* and a narrow region 19*b*. A sealing plug 83 is initially engaged in narrow region 19*b* and ensures sealing of the bottle at the tip level. After activation, if one wishes to remove the liquid from the bottle, a syringe is engaged in tip 19. A Luer type cone on this syringe pushes the seal into broad region 19*a*, thereby allowing the liquid to flow. The other components are respectively identical to the embodiments of FIGS. 4 and 8.

Figure 12:
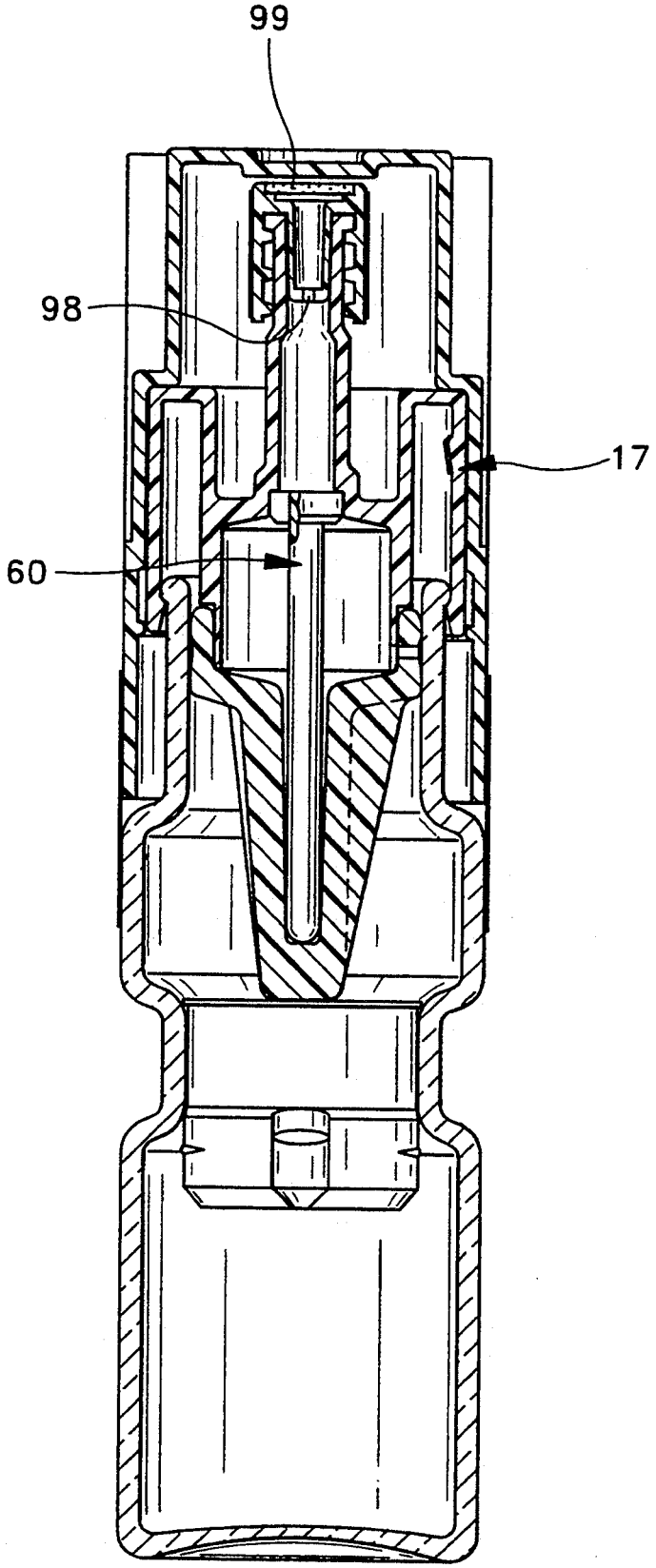

FIG. 12 shows a variation of the embodiment according to FIG. 11. Sealing plug 83 has been eliminated and closing seal 18 screwed onto this tip comprises at one end a central opening 98 and at the other end, a filter 99 constituting a vent hole whose role is identical to that of the filter/vent-holes described previously.

Figure 13:
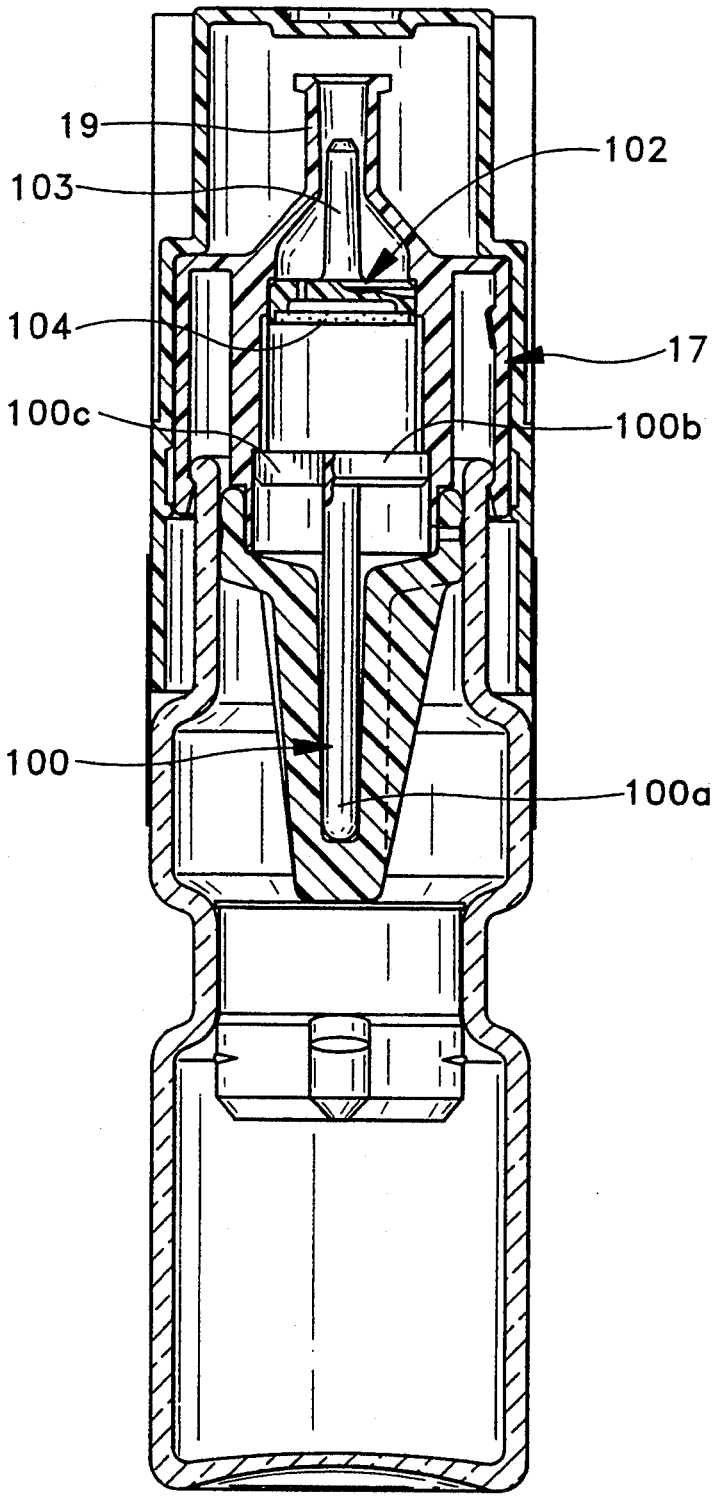

The embodiment of FIG. 13 differs from the preceding constructions by the fact that capsule 17 is provided with a valve 102 located in the base of capsule 17. This valve is activated by a button 103 at the time a syringe (not shown) is positioned in tip 19. A filter/vent hole 104 is disposed near the base of the capsule. Rigid element 100 comprises a central shaft 100*a* and a disc 100*b*, the diameter of which corresponds essentially to the interior diameter of the capsule and which has an opening 100*c* for passage of liquid.

Figure 14:
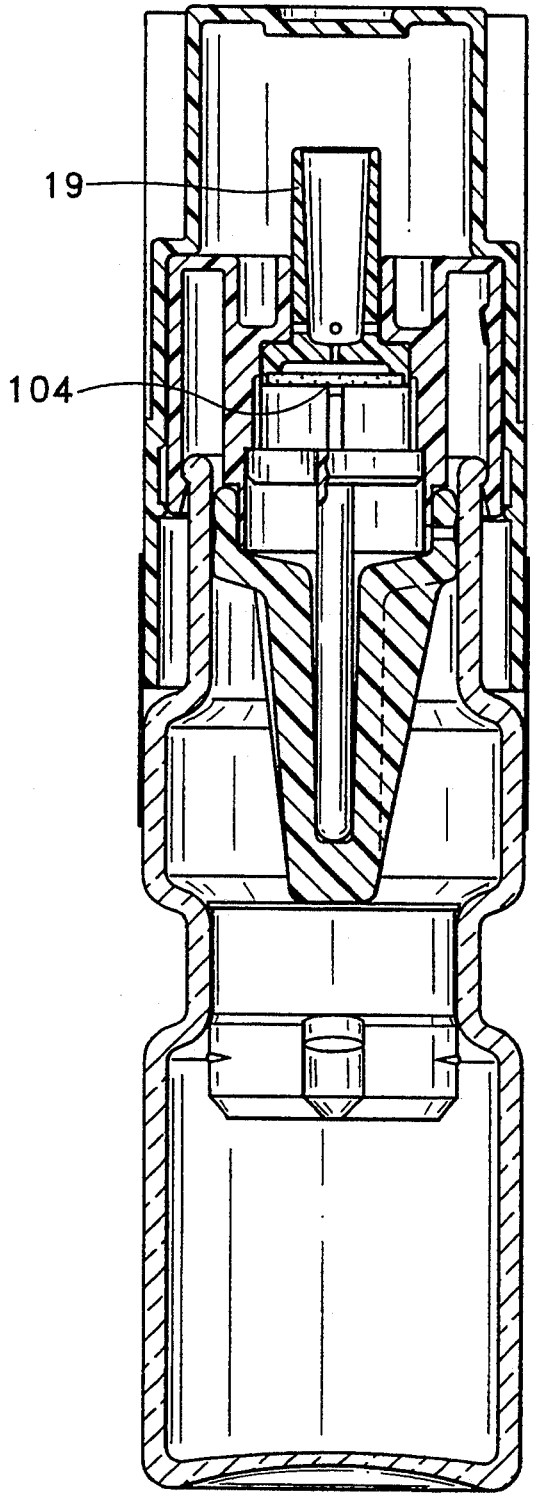

The construction shown in FIG. 14 is a variation of that of FIG. 13. Tip 19 is in the form of a Luer cone and the base of the capsule is provided with a filter 104 serving as a vent hole.

The present invention is not limited to the forms of embodiments shown, but may undergo various modifications and take the form of various embodiments obvious to one skilled in the art. In particular, the shape of the rigid element may be modified. As has been shown in the different embodiments above, this rigid element may be connected either to the sealing device engaged in the neck of the bottle, or to the movable intermediate seal, or to both of these components. The longitudinal dimension is determined by the course of the sealing device in the neck of the bottle. This course must be sufficient to allow the movable intermediate seal to be pushed inside compartment 12 of the bottle and, in the case where the sealing device comprises a sealing member with a radial opening, to allow the radial opening to be disengaged for passage of the medicinal substance toward the outlet tip of the capsule. The bottle itself may be made of glass or synthetic material. The upper compartment may hold any liquid or solid substance and, in the case of a liquid, may be filled in any manner.

We claim:

1. A storage and transfer bottle for storing two components of a medicinal substance, at least one of which is in liquid state, and transferring this substance, directly or after mixture, into a medical device comprising:

a generally cylindrical bottle member, said bottle member being closed at one end, having a narrow open neck at an opposite end, and a sealing device engaged in said neck;

said bottle member having a centrally located narrow region separating the bottle member into upper and lower compartments and a moveable intermediate seal that seals the narrow region during a storage phase, thereby, isolating the two components from each other, one in each compartment;

said sealing device having an elastomeric sealing portion engaged in the narrow neck, said sealing device being displaceable between a first storage position during a storage phase in which said elastomeric sealing portion tightly seals the narrow neck, and a second utility position during a utility phase for allowing said medicinal substance to be transferred;

said sealing device having a rigid capsule partially engaged inside the narrow neck and attached to said sealing portion;

wherein, said elastomeric sealing portion has an outside diameter essentially equal to the inside diameter of the narrow neck to ensure sealing of the bottle at neck level during the storage phase, and an extension of said elastomeric sealing portion that extends through a compartment of the bottle that is defined by said sealing portion and said intermediate seal;

said sealing device has a rigid extension that is coextensive with the extension of said elastomeric sealing portion, such that an end of the rigid extension rests on said intermediate seal forming a rigid pushing member for moving the intermediate seal out of engagement with said narrow region during the utility phase.

2. A bottle according to claim 1, wherein said rigid pushing member is attached inside the extension of the sealing section.

3. A bottle according to claim 2, wherein the rigid pushing member consists of a central shaft made as one piece with the capsule.

4. A bottle according to claim 2, wherein the rigid pushing member is an independent piece positioned between the capsule and the extension of the sealing portion.

5. A bottle according to claim 1, wherein the sealing portion has at least one radial opening sealed by the interior wall of the narrow neck during the storage phase and open toward the interior of the upper compartment during the utility phase.

6. A bottle according to claim 1, wherein the capsule has a base having at least one opening serving as a vent hole.

7. A bottle according to claim 6, wherein said vent hole has a filter (44).

8. A bottle according to claim 7, wherein said filter is attached to the outside of the base of the capsule (17).

* * * * *